US005725349A

United States Patent [19]

Garvey et al.

[11] Patent Number: 5,725,349

[45] Date of Patent: Mar. 10, 1998

[54] METHOD AND APPARATUS FOR REMOVING SHRINKWRAP FROM A PACKAGE OF BOTTLES

[75] Inventors: Francis J. Garvey, Newfield; William J. Garvey, Sweetwater, both of N.J.

[73] Assignee: Garvey Corporation, Blue Anchor, N.J.

[21] Appl. No.: 622,674

[22] Filed: Mar. 26, 1996

[51] Int. Cl.[6] ..... B65B 69/00; B65G 65/02

[52] U.S. Cl. ..... 414/412; 53/492; 83/171; 83/404.2; 83/946; 414/786

[58] Field of Search ..... 414/412, 786; 83/171, 404.2, 404.3, 946; 53/492, 381.2, 384.1

[56] References Cited

U.S. PATENT DOCUMENTS

| | | | |
|---|---|---|---|
| 2,756,819 | 7/1956 | Judelson | 83/171 X |
| 3,889,442 | 6/1975 | Grahn et al. | 414/412 X |
| 3,990,336 | 11/1976 | Soodalter | 83/404.2 |
| 4,050,223 | 9/1977 | Steeg et al. | 53/439 |
| 4,162,019 | 7/1979 | Joa | 414/412 |
| 4,390,313 | 6/1983 | Hoehn | 414/412 |
| 4,457,123 | 7/1984 | Hoehn | 53/492 |
| 4,929,141 | 5/1990 | Keesey et al. | 414/412 |
| 5,069,594 | 12/1991 | Bott et al. | 414/412 |

FOREIGN PATENT DOCUMENTS 2423403 11/1979 France .

*Primary Examiner*—David A. Bucci

[57] ABSTRACT

A method and apparatus for removing shrinkwrap from a plurality of bottles encased in the same and arranged in the form of a substantially rectangular package. The apparatus includes a base frame that has an upper support surface. Extending upwardly through the support surface is a first cutting assembly. Spaced from the first cutting assembly and also extending upwardly through the support surface is a second cutting assembly. A pusher is connected to the base frame and is adapted to move the package along the support surface over the first cutting assembly in order to effectuate a lengthwise cut in the bottom of the package. A second pusher is also secured to the base frame and is adapted to move the package across the support surface over the second cutting assembly in order to effectuate a widthwise cut in the bottom of the package. The shrinkwrap removing apparatus also includes a debagging station for removing the shrinkwrap from the plurality of bottles. More specifically, the debagging station includes a vertical channel positioned adjacent the second cutting assembly, friction means secured to the inside periphery of the vertical channel and a lower platen for supporting the bottles as they are moved up and down the vertical channel upon actuation of a pneumatic cylinder.

11 Claims, 7 Drawing Sheets

125
129
132
126
124
128
131
127
36
122
118
134
116
120
138
114
130
140
16
96
142
90
144
90
110
150
148
140
152
112
102
100
98
92
106
92
104
108

METHOD AND APPARATUS FOR REMOVING SHRINKWRAP FROM A PACKAGE OF BOTTLES

BACKGROUND OF THE INVENTION

This invention relates to an apparatus for removing shrinkwrap from a package of bottles and, more particularly, to such an apparatus that automatically removes the shrinkwrap quickly and easily. The present invention also relates to a method for removing shrinkwrap from a plurality of packaged bottles.

Heretofore, the most common way of removing shrinkwrap from a package of bottles is by employing workers to manually cut and remove the shrinkwrap from the bottles. This is very time consuming and results in high manufacturing costs.

In recognition of the foregoing, machines have been proposed to automatically remove shrinkwrap or other wrapping from a package. Published French Patent Application No. 2,423,403 to Wazières, for example, discloses such a machine. The Wazières unwrapping machine includes a conveyor which moves a wrapped package of bottles past cutters to cut open the upper side edges of the package. Thereafter, the upper ends of the individual rows of bottles situated in the package are passed between adjacent pairs of slats. The slats maintain the bottles in place while mechanical fingers move the wrapping material downwardly away from the bottles. A drawback with this device is that the top layer of wrapping material is not removed by the fingers and, therefore, must be removed manually. Furthermore, the device is quite complex.

U.S. Pat. No. 5,069,594 discloses a bottle debagging and feeding apparatus that includes a debagging station and a loading station. The debagging station includes a cutting mechanism and a pair of rollers. In use, the package is placed on the loading station where the rollers grasp the shrinkwrap and pull it tight. Thereafter, the cutting mechanism is activated to slice open the shrinkwrap. However, once the shrinkwrap has been cut open, the operator must manually remove the shrinkwrap from bottles.

Similarly, U.S. Pat. No. 3,889,442 discloses a device for removing shrinkwrap from a package of bottles. This is an extremely complicated device that utilizes a number of moving parts and cutting mechanisms and, therefore, is highly impractical.

SUMMARY OF THE INVENTION

The present invention is designed to overcome the deficiencies discussed above. It is an object of the present invention to provide an apparatus that can quickly and efficiently remove shrinkwrap from a package of bottles or other similar items.

It is a further object to provide a method of removing shrinkwrap from a package of bottles.

In accordance with the illustrative embodiments, demonstrating features and advantages of the present invention, there is provided an apparatus for removing shrinkwrap from a plurality of bottles encased in the same and arranged in the form of a substantially rectangular package. The shrinkwrap removing apparatus includes a base frame that has an upper support surface. An infeed conveyor for transporting the package of bottles partially extends over the support surface. Extending upwardly through the support surface adjacent the infeed conveyor is a first cutting assembly. Spaced from the first cutting assembly and also extending upwardly through the support surface is a second cutting assembly. A pusher is connected to the base frame and is adapted to move the package across the infeed conveyor and along the support surface over the first cutting assembly in order to effectuate a lengthwise cut in the bottom of the package. A second pusher is also secured to the base frame and is adapted to move the package across the support surface over the second cutting assembly in order to effectuate a widthwise cut in the bottom of the package.

The shrinkwrap removing apparatus also includes a debagging station for removing the shrinkwrap from the plurality of bottles after the cuts have been made in the bottom of the package. More specifically, the debagging station includes a vertical channel positioned adjacent the second cutting assembly and friction means secured to the inside periphery of the vertical channel for engaging and stripping the plastic wrap. The debagging station also includes a lower platen for supporting the bottles as they are moved up and down through the vertical channel upon actuation of a pneumatic cylinder by means well known in the art.

Other objects, features and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
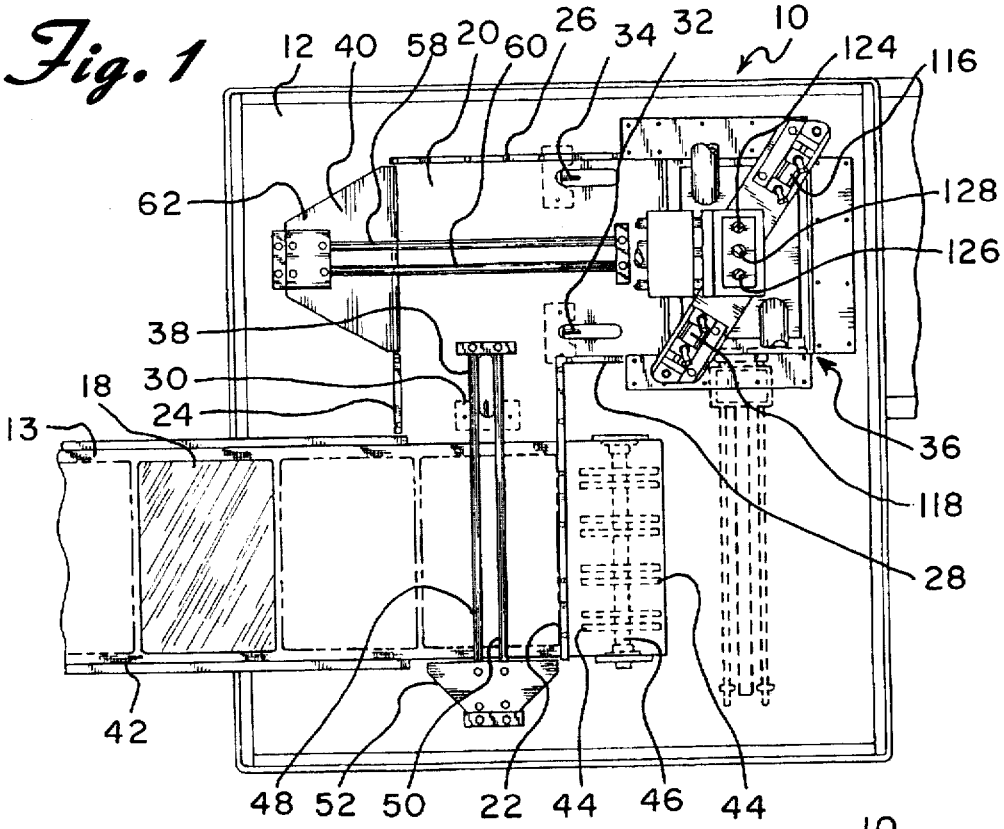
FIG. 1 is a top plan view of the shrinkwrap removing apparatus of the present invention.

Referring now to the drawings in detail, wherein like reference numerals have been used throughout the various figures to designate like elements, there is shown in FIG. 1 an apparatus for removing the shrinkwrap from a plurality of packaged bottles constructed in accordance with the principles of the present invention and designated generally as 10.

Figure 6:
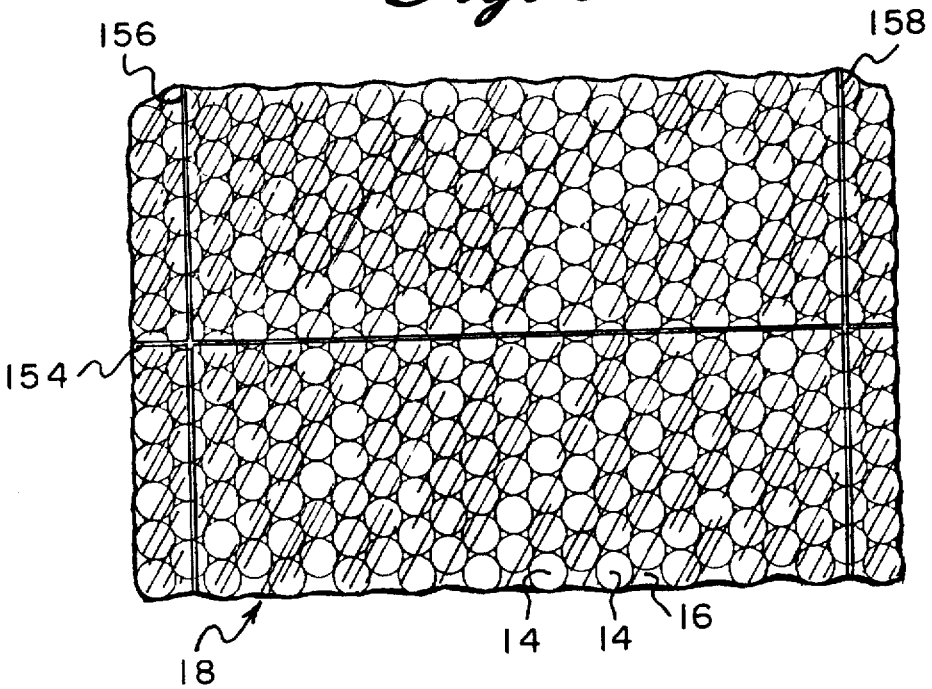
FIG. 6 is a partial bottom plan view of a package of shrinkwrapped bottles.

The shrinkwrap removing apparatus 10 includes a base frame 12. An infeed conveyor 13 extends into one side of the base frame 12 and is adapted to laterally move a plurality of bottles 14 encased in shrinkwrap 16 (see FIG. 6) and arranged in a substantially rectangular package 18. An L-shaped support surface 20 defined by guide rails 22, 24, 26 and 28 is located atop the base frame 12. The guide rails are bolted to the base frame 12. However, they can be secured in a number of different ways. For example, the guide rails can be movably secured to the base frame so as to accommodate packages of varying sizes.

Extending upwardly through the L-shaped support surface 20 is a first cutter assembly 30 and two spaced apart second cutter assemblies 32 and 34. A debagging station 36 is positioned adjacent the second cutter assemblies 32 and 34.

A first pusher assembly 38 is adapted to move the package of bottles 18 along the L-shaped support surface 20 and over the first cutting assembly 30. Similarly, a second pusher assembly 40 is adapted to move the package across the L-shaped support surface, over the second cutting assemblies 32 and 34 and into the debagging station 36 where the shrinkwrap 16 is removed from the bottles 14 as more fully described below.

Figure 2:
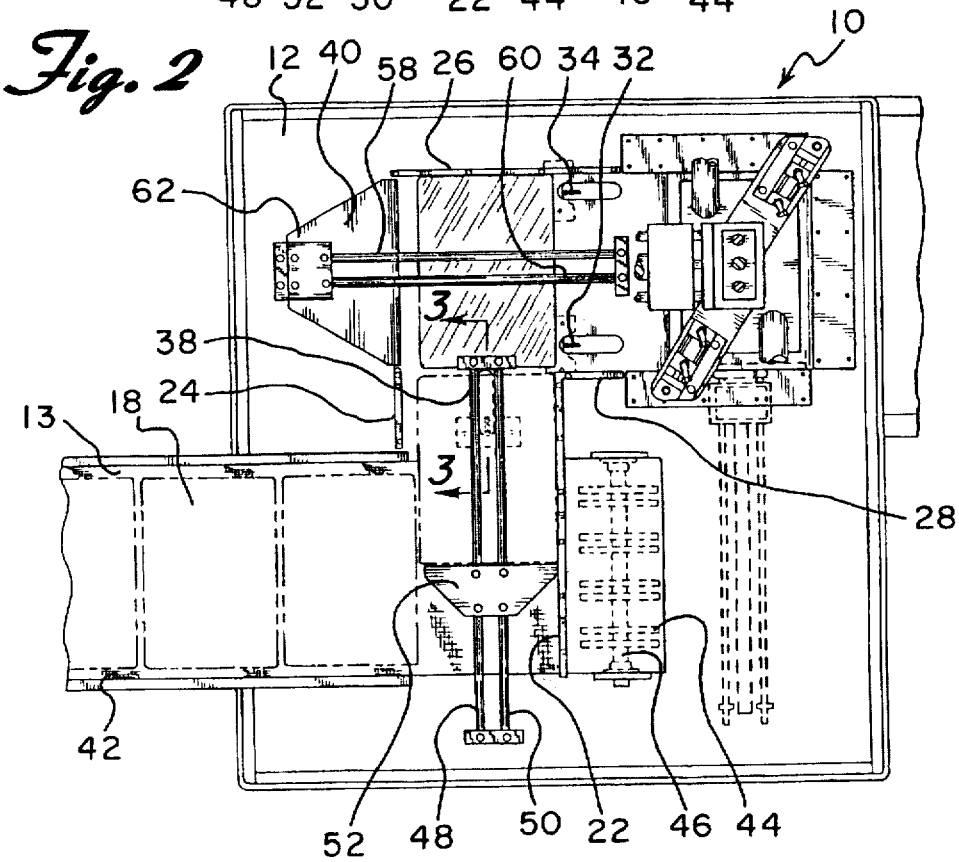
FIG. 2 is a view similar to FIG. 1.

Referring to FIGS. 1 and 2, the infeed conveyor 13 is adapted to laterally move the package of bottles 18 toward the first pusher assembly 38. The infeed conveyor is of the type generally known in the art and includes an endless belt 42 wrapped around a plurality of pulleys 44. The pulleys are mounted upon axle 46 and are driven by a motor (not shown) which laterally moves the belt.

The first pusher assembly 38 includes a pair of guide rods 48 and 50 secured to and positioned above the base frame 12 and a pneumatic pusher member 52 mounted for axial movement along the guide rods 48 and 50 in a manner known in the art. Similarly, the second pusher assembly 40 includes a pair of guide rods 58 and 60 secured to and positioned above the base frame 12 and a pneumatic pusher member 62 mounted for axial movement along the guide rods 58 and 60.

Figure 3:
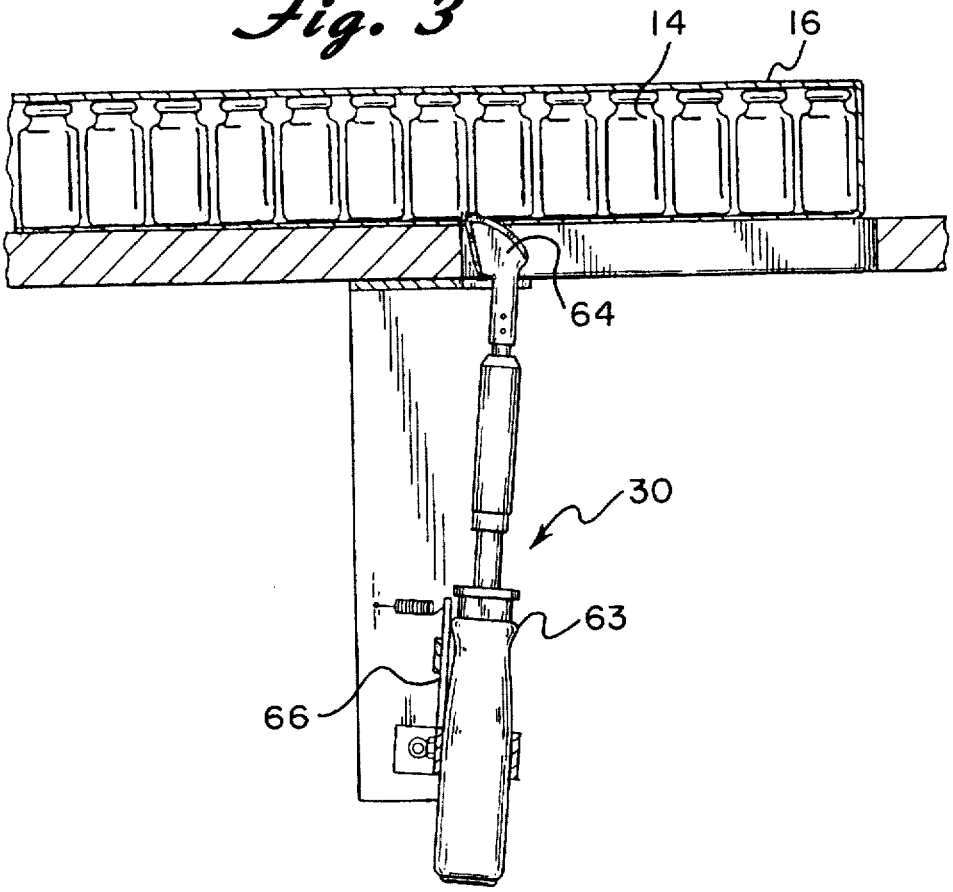
FIG. 3 is a partial cross-sectional view taken along lines 3—3 of FIG. 2.

Referring to FIG. 3, the first cutter assembly 30 includes a housing 63 and a spring loaded knife blade 64 extending upwardly therefrom. The housing 63 is secured to the base frame 12 by means of a bracket 66. The knife blade extends partially up through an opening in the L-shaped support surface 20 and is preferably connected to an energy source (not shown) which sends heat energy to the knife blade so that it can readily cut through the shrinkwrap 16 as more fully described below.

Figure 5:
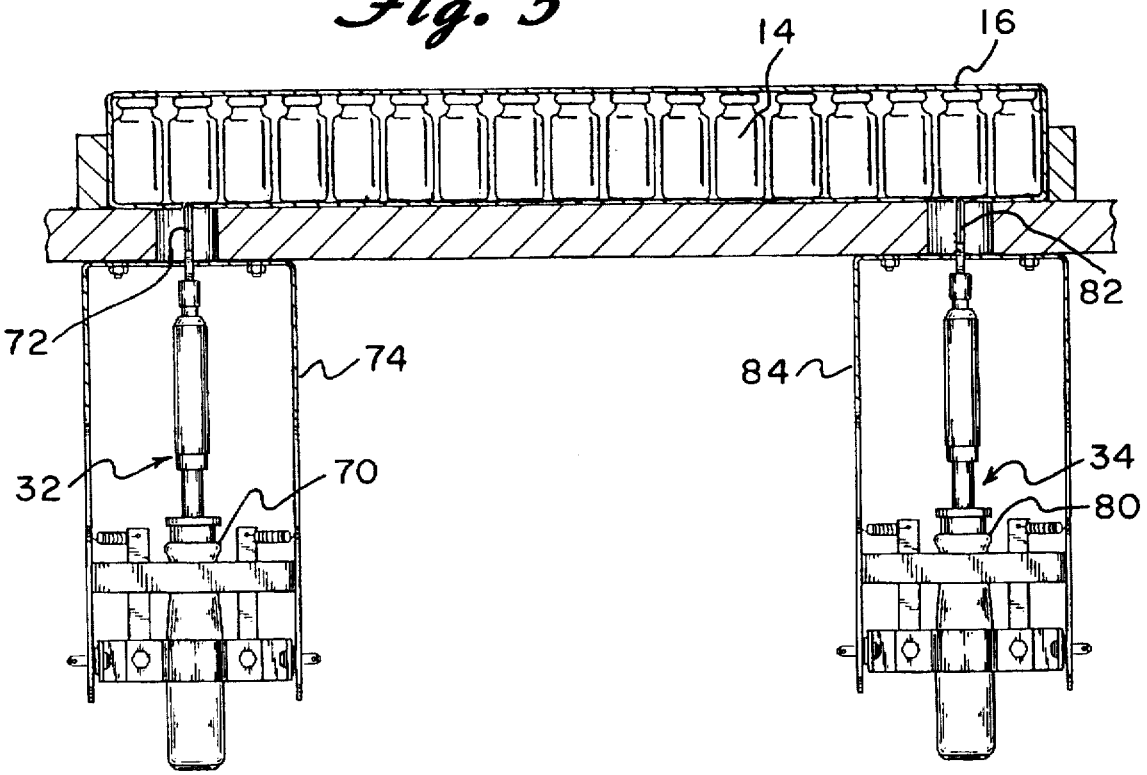
FIG. 5 is a partial cross-sectional view taken along lines 5—5 of FIG. 4.

Referring to FIG. 5, the second cutter assemblies 32 and 34 are shown. The second cutter assemblies are substantially identical to each other. Accordingly, only one of the second cutter assemblies will be described in detail, it being understood that the description applies equally to the other second cutter assembly. The second cutter assembly 32 includes a housing 70 and a spring loaded knife blade 72 extending upwardly therefrom. The housing 70 is secured to the base frame 12 by means of a bracket 74. The knife blade 72 partially extends up through an opening in the L-shaped support surface 20. The knife blade 72 is heated by an energy source (not shown) connected thereto which passes heat energy to the knife blade so as to facilitate the cutting of the shrinkwrap 16. Similarly, second cutter assembly 34 includes a housing 80, a spring loaded knife blade 82 extending upwardly therefrom and a bracket 84 for securing the assembly 34 to the base frame 12.

Figure 4:
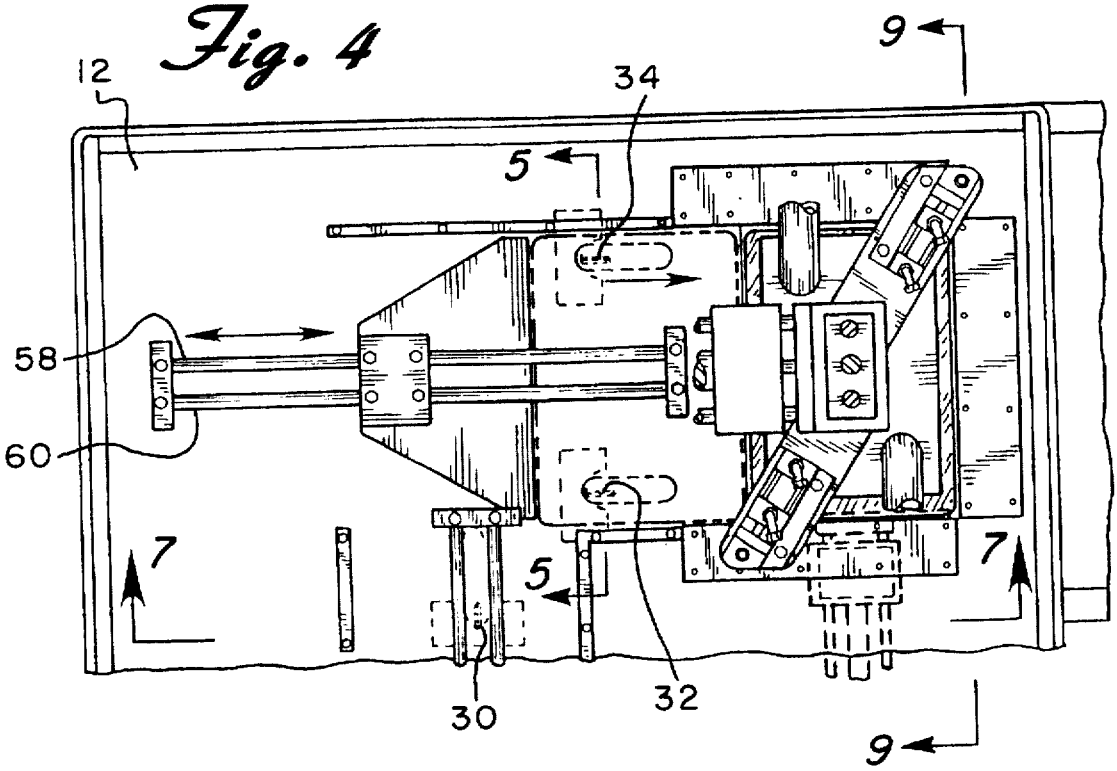
FIG. 4 is an enlarged top plan view of a portion of the shrinkwrap removing apparatus.
Figure 9:
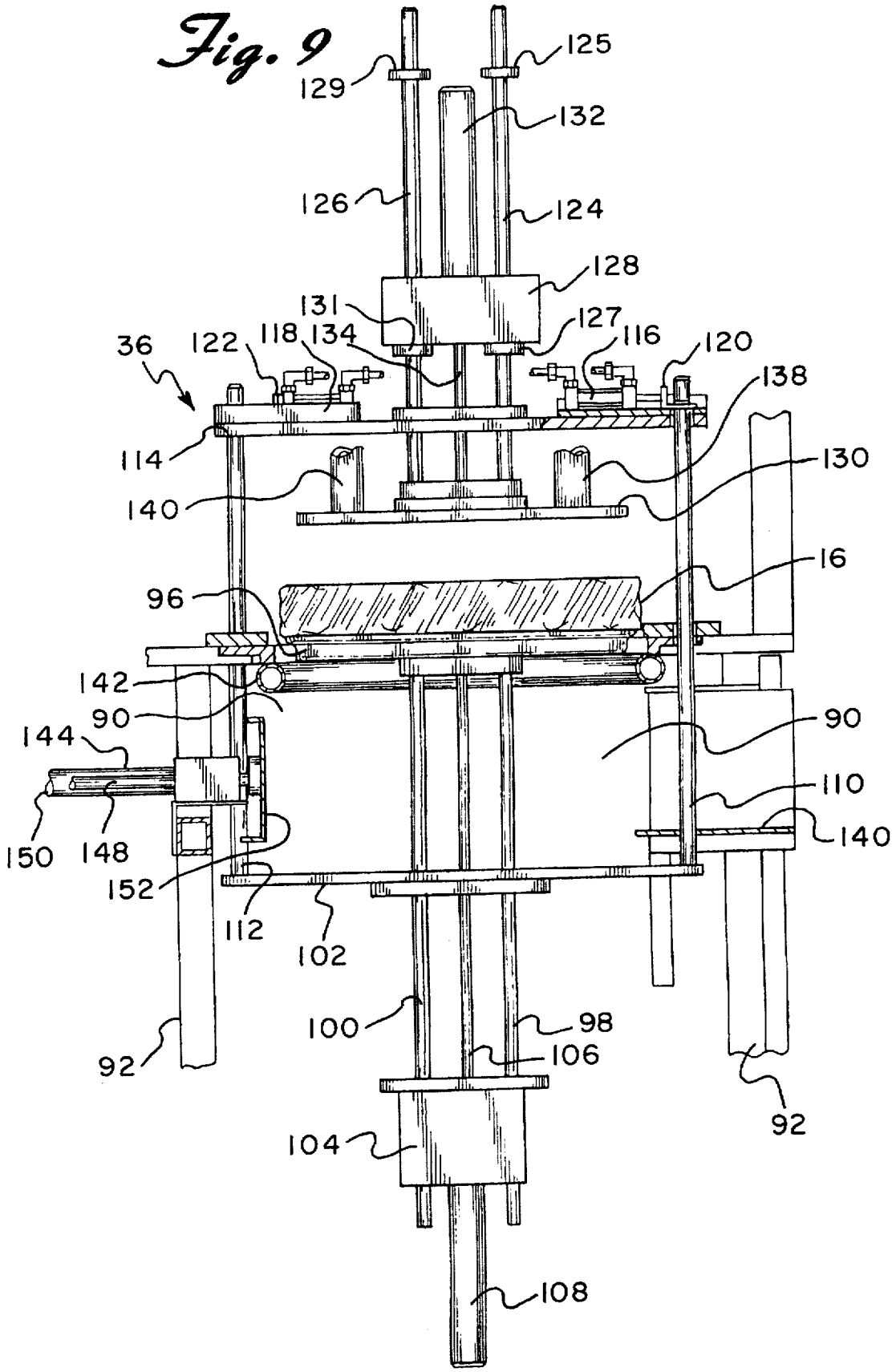
FIG. 9 side view of the debagging station taken along lines 9—9 of FIG. 4.
Figure 10:
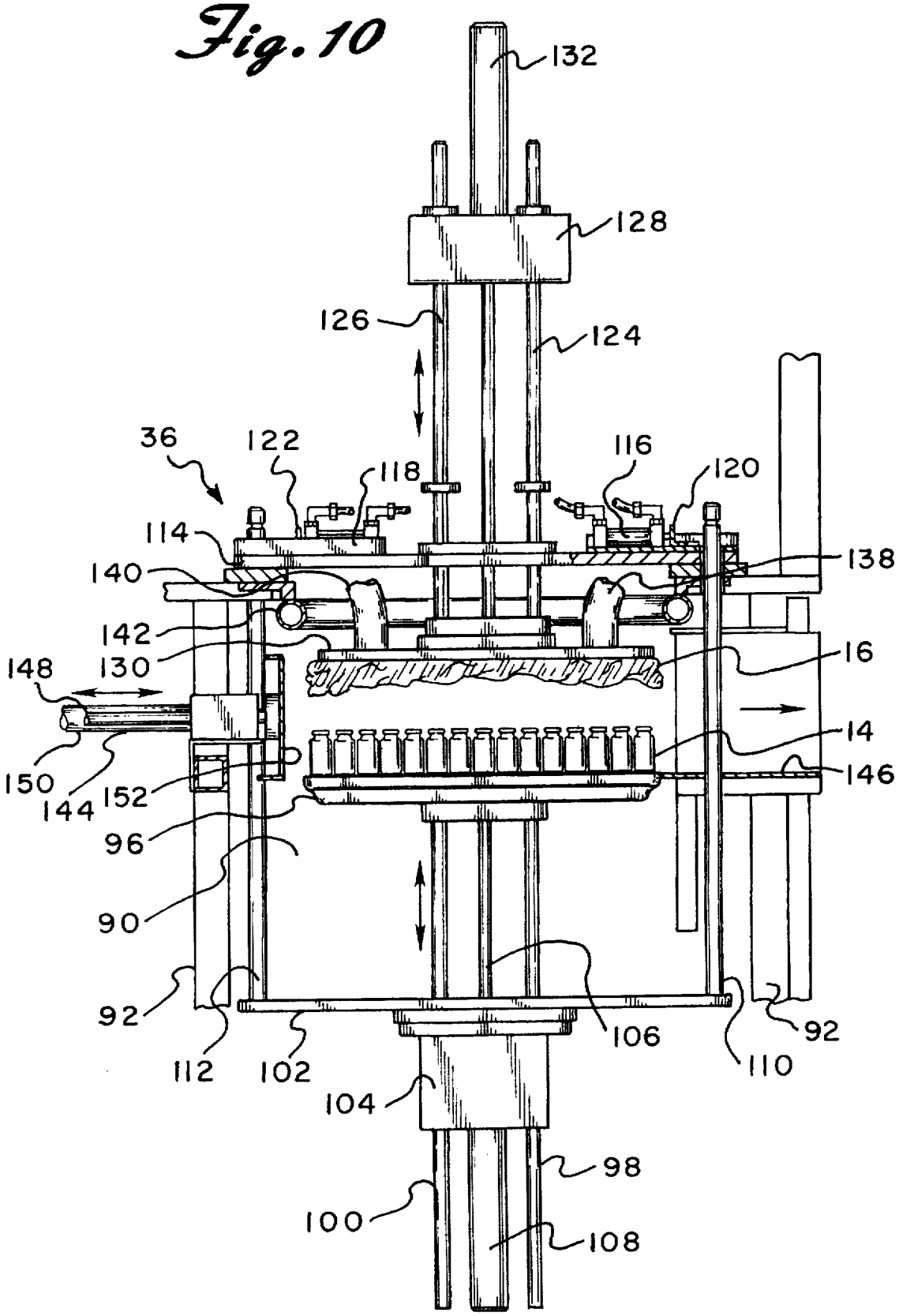
FIG. 10 is a view similar to FIG. 9.

Referring to FIGS. 4, 9 and 10 the debagging station 36 includes a vertical channel 90 located adjacent one end of the L-shaped support surface 20 and defined by a hollow rectangular frame 92. A lower platen 96 for supporting the package of bottles is vertically movable within the channel 90. More specifically, guide rods 98 and 100 each have an end connected to the bottom of the lower platen 96. The guide rods 98 and 100 extend downwardly from the bottom of the lower platen, through lower planar member 102 and through sliding bearing 104. A piston rod 106 has one end secured to the lower platen 96 and the other end connected to a pneumatic cylinder 108. Of course, the piston rod could be connected to a solenoid or other mechanical device instead of the pneumatic cylinder.

Extending upwardly from opposite ends of lower planar member 102 are bars 110 and 112. Each of the bars 110 and 112 extends through upper planar member 114 and has a corresponding recess 113 and 115 formed in the top thereof (see FIG. 12). Secured to the top of opposite ends of the upper planar member 114 are pneumatic cylinders 116 and 118. A locking pin 120 is associated with pneumatic cylinder 116 and a locking pin 122 is associated with pneumatic cylinder 118. Locking pin 120 is adapted to engage or disengage the recess in the top of the bar 110 upon actuation of pneumatic cylinder 116 in a manner known in the art. Similarly, locking pin 122 is adapted to engage the recess in the top of the bar 112 upon actuation of pneumatic cylinder 118. It should be noted that a solenoid or other similar device can be used in place of the pneumatic cylinders 116 and 118 to move the locking pins into or out of the recesses in the bars.

Upper guide rods 124 and 126 extend downwardly from a housing 128 and partially through the upper planar member 114. Guide rod 124 has upper and lower stop members 125 and 127 secured thereto. Similarly, guide rod 126 has upper and lower stop members 129 and 131 secured thereto. The housing 128 is positioned between the upper and lower stop members.

Figure 7:
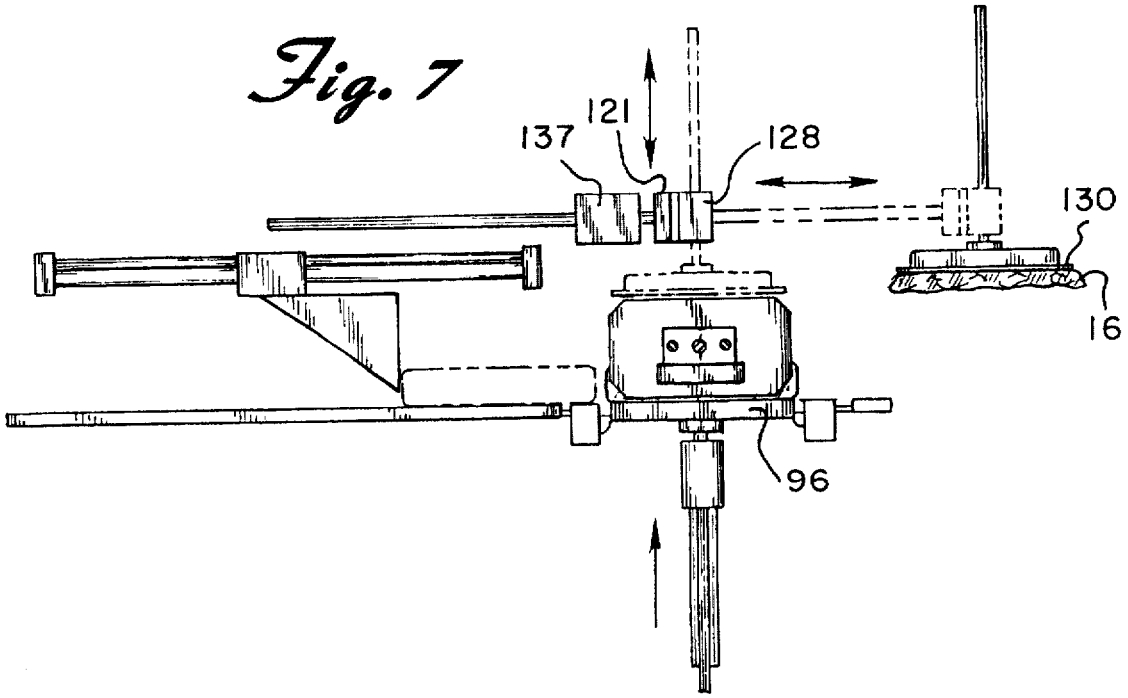
FIG. 7 is a side view taken along lines 7—7 of FIG. 4.
Figure 8:
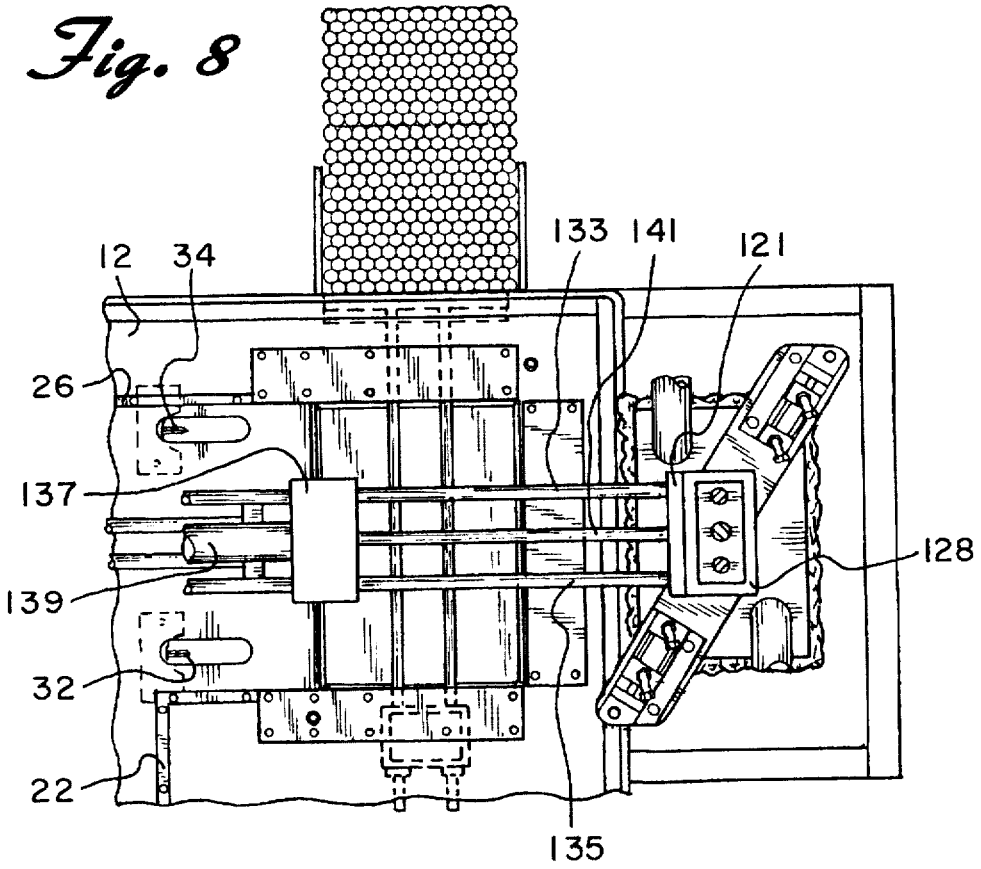
FIG. 8 is a partial top plan view of the shrinkwrap removing apparatus.

Referring to FIGS. 7 and 8, a driving member 121 is secured to one side of housing 128. Guide rods 133 and 135 each have an end secured to the driving member 121 and extend through a bearing member 137. A pneumatic cylinder 139 is secured to the bearing member 137. A piston rod 141 has one end extending through the bearing member 137 and slidably mounted in the cylinder 139. The other end of the piston rod 141 is connected to the driving member 121.

Referring to FIGS. 9 and 10, guide rods 124 and 126 each have an end secured to upper platen 130. A pneumatic cylinder 132 is mounted atop the housing 128. Piston rod 134 has one end extending up through the housing 128 and slidably mounted in the cylinder 132. The other end of the piston rod is connected to the upper platen 130. A pair of vacuum hoses 138 and 140 are secured to the top of the upper platen 130. The vacuum hoses are secured to a vacuum supplying source (not shown).

Tubing 142 is secured around the upper periphery of the frame 92. It should be noted that the tubing can be arranged vertically or horizontally along the inside of the frame 92 and can be one uniform strip or a plurality of strips. The tubing is preferably comprised of an elastomeric resin such as the type denoted by the trademark TYGON. However, it can be made of a variety of other materials. The tubing frictionally engages the shrinkwrap 16 from the package of bottles when the lower platen 96 is moved down the vertical channel 90 as more fully described below. Mechanical fingers (not shown) can be used in place of the tubing to engage the shrinkwrap as it is moved down the vertical channel.

A third pusher assembly 144 is adapted to laterally move the unwrapped bottles off the lower platen 96 and onto an outfeed conveyor 146. The third pusher assembly 144 includes a piston rod 148 mounted for lateral movement in a pneumatic cylinder 150. A pusher member 152 is secured to the distal end of the piston rod. The pusher member 152 engages the unwrapped package of bottles 14 and transports them across the lower platen 96 and onto the outfeed conveyor 146 upon proper actuation.

To facilitate an understanding of the principles associated with the foregoing apparatus and method, its operation will now be briefly described. A package 18 of bottles 14 wrapped in shrinkwrap 16 is placed onto the infeed conveyor 13 (see FIG. 1). The package is moved toward guide rail 22. When a side of the package contacts guide rail 22, the pneumatic pusher member 52 of the first pusher assembly 38 is actuated and moves the package across the infeed conveyor 13 and over the heated spring loaded knife blade 64 of the first cutter assembly 30. The knife blade effectuates a lengthwise cut 154 in the bottom of the shrinkwrap 16 (see FIGS. 1 and 6). The package is moved across the L-shaped support surface 20 until it contacts guide rail 26.

Thereafter, the pneumatic pusher member 62 of the second pusher assembly 40 is actuated to move the package along the L-shaped support surface 20 and over heated knife blades 72 and 82 of second cutter assemblies 32 and 34, respectively. The knife blades 72 and 82 effectuate widthwise cuts 156 and 158 in the bottom of the shrinkwrap 16 (see FIG. 6).

Figure 11:
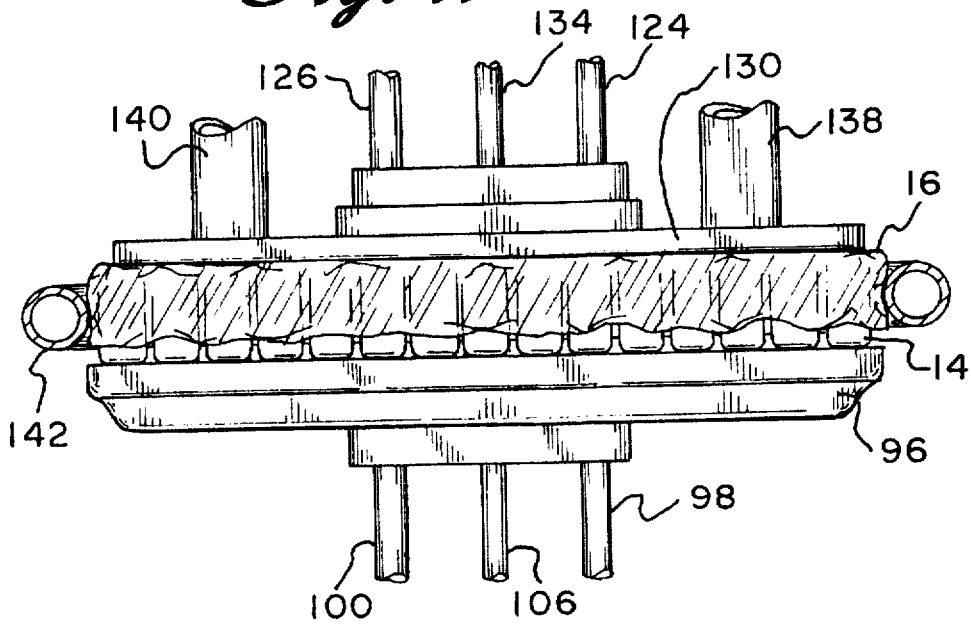
FIG. 11 is a side view of the bottles shown positioned between upper and lower platens.

The pneumatic pusher 62 then moves the package 18 onto the lower platen 96 in the debagging station 36 (see FIG. 9). Thereafter, pneumatic cylinder 132 is actuated to lower the upper platen 130 onto the top of the package 18 of bottles. The upper and lower platens 130 and 96, respectively, with the package 18 of bottles therebetween, are then locked together and are lowered downwardly into the vertical channel 90. As the package is lowered, the TYGON tubing 142 frictionally engages the shrinkwrap 16 causing the same to be pulled upwardly away from the bottles 14 as best shown in FIG. 11. This is made possible by the cuts 154, 156 and 158 made in the bottom of the shrinkwrap.

As the shrinkwrap 16 is being pulled upwardly away from the bottles 14, the vacuum supplying source is actuated thereby causing air pressure to flow upwardly through the hoses 138 and 140 which are secured to the upper planar member 114. Accordingly, the shrinkwrap is forced against the upper platen 130 (see FIG. 10).

Figure 12:
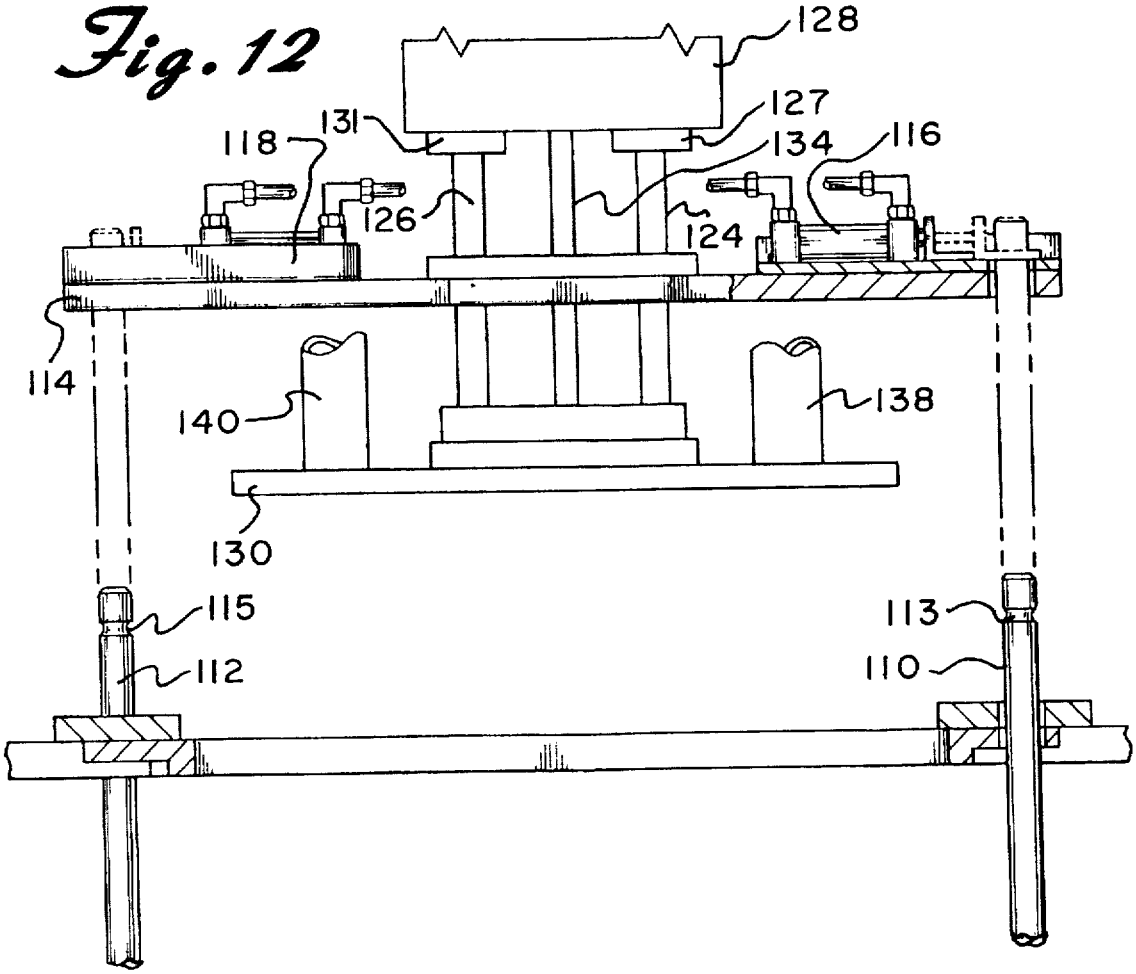
FIG. 12 is a side view of the debagging station.

Pneumatic cylinders 116 and 118 are then triggered to cause locking pins 120 and 122 to be disengaged from the recesses in the top of the bars 110 and 112, respectively. Thereafter, pneumatic cylinder 132 is actuated to lift the upper platen 130 and the shrinkwrap 16 up out of the vertical channel 90 and away from the lower platen 96 as shown in FIG. 12.

The upper platen 130 is then moved laterally past the base frame 12 and preferably over a waste receptacle or the like. This is accomplished by actuating pneumatic cylinder 139 in a manner known in the art (see FIGS. 7 and 8). Thereafter, the vacuum supplying source is reversed so that air is forced out of the vacuum hoses 138 and 140 so that the shrinkwrap 16 is blown away from the upper platen 130 and into the receptacle. The upper platen is then moved back over the debagging station 36.

Pneumatic cylinder 150 is actuated to laterally move pusher member 152 of the third pusher assembly 144 against the package of unwrapped bottles 14. The pusher member 152 pushes the bottles off of the lower platen 96 and onto an outfeed conveyor 146 (see FIGS. 8–10). The pusher member 152 is then pulled back to its original position.

The pneumatic cylinder 108 is then actuated to move the lower platen 96 and planar member 102 upward until the attached bars 110 and 112 once again extend through the upper planar member 114. Pneumatic cylinders 116 and 118 are actuated to cause each of the locking pins 120 and 122 to engage one of the corresponding recesses 113 and 115 in the bars and the process is ready to begin again.

The present invention may be embodied in other specific forms without departing from the spirit or essential attributes thereof and accordingly reference should be made to the appended claims rather than to the foregoing specification as indicating the scope of the invention. By way of example, and not limitation, the pneumatic cylinders can be replaced with various mechanical devices such as cams and levers.

What is claimed is:

1. An apparatus for removing shrinkwrap from a plurality of articles encased in the same and arranged in the form of a substantially rectangular package comprising:

a base frame having an upper support surface;

a first cutting means extending upwardly through said support surface;

a second cutting means extending upwardly through said support surface and being spaced from said first cutting means;

a first pusher means for moving said package along said support surface, said first cutting means effectuating a lengthwise cut through said shrinkwrap on the bottom of said package when said first pusher means moves said package along said support surface;

a second pusher means for moving said package across said support surface, said second cutting means effectuating a widthwise cut through the shrinkwrap on the bottom of said package when said second pusher means moves said package across said support surface, and debagging means for removing said shrinkwrap from said plurality of articles, said debagging means including a vertical channel positioned adjacent said second cutting assembly, said vertical channel having an upper end and a lower end; a lower platen secured to said base frame for supporting said articles and being vertically movable within said channel, and friction means secured to the support surface around the periphery of said vertical channel for engaging said shrinkwrap.

2. The shrinkwrap removing apparatus of claim 1 further including an infeed conveyor means for transporting said package, said infeed conveyor means partially extending over said support surface and having an end adjacent said first cutting means, said first pusher means being adapted to move said package across said infeed conveyor means and onto said support surface.

3. The shrinkwrap removing apparatus of claim 1 wherein said first cutting means includes a heated knife extending upwardly from said upper support surface.

4. The shrinkwrap removing apparatus of claim 3 wherein said second cutting means includes a pair of spaced apart heated knives extending upwardly from said upper support surface.

5. The shrinkwrap removing apparatus of claim 1 wherein said debagging means further includes an upper platen secured to said base frame and located above said lower platen, said upper platen being vertically movable into said channel.

6. The shrinkwrap removing apparatus of claim 5 wherein said debagging station further includes means for removably securing said upper platen to said lower platen.

7. The shrinkwrap removing apparatus of claim 5 wherein said debagging station further includes vacuum means secured to said upper platen for attracting said shrinkwrap to said upper platen when said shrinkwrap is pulled upwardly away from said articles as said lower platen is moved downwardly in said vertically channel.

8. The shrinkwrap removing apparatus of claim 1 further including a third pusher means and an outfeed conveyor means, said third pusher means being adapted to move said package across said lower platen and onto said outfeed conveyor means after said shrinkwrap has been removed said articles.

9. The shrinkwrap removing apparatus of claim 7 wherein said upper platen is laterally movable away from said lower platen and said vacuum means is adapted to force said shrinkwrap away from said upper platen when the same is laterally moved away from said lower platen.

10. A method for removing shrinkwrap from a plurality of articles encased in the same and arranged in the form of a substantially rectangular package comprising the steps of:

placing said package on a support surface;

moving said package along first cutting means in order to effectuate a lengthwise cut in the bottom of said package;

moving said package across second cutting means in order to effectuate a widthwise cut in the bottom of said package, and lowering said package down a vertical channel having an engaging means secured around the periphery thereof so that said engaging means contacts said shrinkwrap and lifts the same up away from said articles.

11. The method of claim 10 further including the steps of:

maintaining said shrinkwrap adjacent said friction engaging means as said package is lowered down said vertical channel;

moving said shrinkwrap away from said support surface, and moving said articles onto an outfeed conveyor means. and moving said articles onto an outfeed conveyor means.

* * * * *